US011337567B2

(12) United States Patent
Lewis et al.

(10) Patent No.: US 11,337,567 B2
(45) Date of Patent: May 24, 2022

(54) DISPENSER WITH MECHANICAL TRANSFER AND METHOD

(71) Applicant: Kimberly-Clark Worldwide, Inc., Neenah, WI (US)

(72) Inventors: Richard P. Lewis, Marietta, GA (US); Edward A. Raleigh, Lodi, WI (US); Jeffrey J. Brickl, Prairie Du Sac, WI (US); Matthew T. Woerpel, Lodi, WI (US); Robert Godfrey, Monona, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/281,286

(22) PCT Filed: Apr. 21, 2020

(86) PCT No.: PCT/US2020/070003

§ 371 (c)(1),
(2) Date: Mar. 30, 2021

(87) PCT Pub. No.: WO2021/216138

PCT Pub. Date: Oct. 28, 2021

(65) Prior Publication Data

US 2021/0345840 A1 Nov. 11, 2021

(51) Int. Cl.
*A47K 10/32* (2006.01)

(52) U.S. Cl.
CPC ..... *A47K 10/32* (2013.01); *A47K 2010/324* (2013.01); *A47K 2010/3233* (2013.01);
(Continued)

(58) Field of Classification Search
CPC ..... A47K 10/32; A47K 2010/3233; A47K 2010/324; A47K 2010/3246; A47K 2010/3253
(Continued)

(56) References Cited

U.S. PATENT DOCUMENTS 2,288,332 A * 6/1942 Steiner ..... A47K 10/36 312/34.8
3,084,006 A * 4/1963 Roemer ..... A47K 10/3827 312/34.22
(Continued)

FOREIGN PATENT DOCUMENTS

FR 2870703 A1 * 12/2005 ..... A47K 10/3656
FR 2870703 B1 * 7/2006 ..... A47K 10/3656
(Continued)

OTHER PUBLICATIONS

International Search Report Corresponding to Application No. PCT/US2020/070003 dated Jan. 15, 2021.
(Continued)

*Primary Examiner* — Stephen M Gravini
(74) *Attorney, Agent, or Firm* — Dority & Manning, P.A.

(57) ABSTRACT

A dispenser for dispensing a roll of material is disclosed. The dispenser includes a rear housing and an openable cover. The rear-housing includes a roll transfer apparatus for transferring the roll of material from a first dispensing position to a second dispensing position. The roll transfer apparatus includes a transfer arm engaged with a transfer disk and a transfer latch capable of engaging and disengaging the transfer disk to facilitate movement of the roll of material from a first dispensing position to a second dispensing position. Also disclosed are methods for replacing a roll of material in a dispenser.

19 Claims, 17 Drawing Sheets

(52) U.S. Cl.
CPC ..... *A47K 2010/3246* (2013.01); *A47K 2010/3253* (2013.01)

(58) Field of Classification Search
USPC ..... 34/611; 221/11
See application file for complete search history.

(56) References Cited

U.S. PATENT DOCUMENTS

| | | | | | |
|---|---|---|---|---|---|
| 4,307,638 | A | | 12/1981 | Deluca et al. | |
| 4,307,639 | A | | 12/1981 | Deluca | |
| 4,403,748 | A | * | 9/1983 | Cornell | A47K 10/3687 226/129 |
| 4,520,968 | A | * | 6/1985 | Shpigelman | A47K 10/38 225/47 |
| 4,844,361 | A | | 7/1989 | Granger | |
| 5,172,840 | A | * | 12/1992 | Bloch | A47K 10/3836 225/34 |
| 5,288,032 | A | * | 2/1994 | Boone | A47K 10/36 242/560.3 |
| 5,314,131 | A | * | 5/1994 | McCanless | A47K 10/3836 242/559 |
| 5,558,302 | A | | 9/1996 | Jesperson | |
| 6,079,305 | A | * | 6/2000 | Bloch | B65H 19/10 83/335 |
| 6,145,779 | A | | 11/2000 | Johnson et al. | |
| 6,152,397 | A | * | 11/2000 | Purcell | A47K 10/3687 242/560.1 |
| 6,237,871 | B1 | | 5/2001 | Morand et al. | |
| 6,346,153 | B1 | * | 2/2002 | Lake | A47K 10/32 118/419 |
| 6,592,067 | B2 | * | 7/2003 | Denen | A47K 10/3687 242/560 |
| 6,684,751 | B2 | * | 2/2004 | Kapiloff | A47K 10/3643 225/16 |
| 7,866,593 | B2 | | 1/2011 | Friesen et al. | |
| 8,439,293 | B2 | | 5/2013 | Hagleitner | |
| 10,791,885 | B1 | * | 10/2020 | Paal | A47K 10/3643 |
| 11,137,059 | B2 | * | 10/2021 | Cittadino | B65H 16/005 |
| 11,141,027 | B2 | * | 10/2021 | Starkey | A47K 10/3687 |
| 2007/0278334 | A1 | * | 12/2007 | Granger | A47K 10/3656 242/172 |
| 2008/0078855 | A1 | | 4/2008 | Forman et al. | |
| 2017/0188760 | A1 | | 7/2017 | Henson et al. | |
| 2018/0368629 | A1 | | 12/2018 | Bengtsson et al. | |
| 2020/0062526 | A1 | * | 2/2020 | Formon | B65H 27/00 |
| 2021/0228031 | A1 | * | 7/2021 | Bernacchi | B65H 75/185 |

FOREIGN PATENT DOCUMENTS

| | | | | | |
|---|---|---|---|---|---|
| GB | 2028765 | A | * | 3/1980 | A47K 10/3827 |
| JP | 2004/313261 | A | | 11/2004 | |
| WO | WO-2005117675 | A1 | * | 12/2005 | A47K 10/3656 |
| WO | WO-2020219746 | A1 | * | 10/2020 | A47K 10/26 |

OTHER PUBLICATIONS

"Toilet Paper Dispenser Stub Roll Section", Toilet Paper Dispenser Guide, WebstaurantStore, https://www.webstaurantstore.com/guide/745/toilet-paper-dispenser-guide.html.

* cited by examiner

DISPENSER WITH MECHANICAL TRANSFER AND METHOD

BACKGROUND

Toilet tissue dispensers are known which dispense rolls of toilet tissue. In commercial restrooms, many toilet dispensers are suitable for dispensing oversized or jumbo rolls of materials. Such jumbo rolls typically have a diameter between about 20 to 30 centimeters. Dispensers for oversized or jumbo rolls of toilet tissue are commonly provided in commercial establishments in order to minimize the frequency of roll replacement. Although the replacement interval is extended, the disposition and replacement of the partially spent roll, i.e. the stub roll, remains a problem.

For example, when servicing dispensers containing oversized rolls of materials, service personnel must enter the bathroom stall with a new full roll of bath tissue and keys for opening the dispenser. After opening the dispenser, the service personnel must move a partially used stub roll from the primary position before loading the new full roll. Additionally, the service personnel may have to remove a previously dispensed core. It is difficult if not impossible for service personnel to perform these actions while holding the new full roll given the oversized nature of such rolls. In such cases, it is not desirable put the new roll down either on the toilet or the floor of the restroom for hygienic reasons.

In view of the above, a need exists for a dispenser that allows for replacement of the used roll with a new roll of material that can be accomplished without exposing the new roll of material to contamination.

SUMMARY

In general, the present disclosure is directed to a dispenser that can facilitate easier removal of stub rolls and installment of new rolls of material. In one embodiment, the dispenser includes a housing having a rear housing and an openable cover that defines a housing interior. The housing interior is configured to receive a roll of material having a diameter. The roll of material may include an oversized or jumbo roll of material. The rear housing includes a backplate to be mounted to a mounting surface, such as the stall wall of a commercial restroom. The housing interior is configured to receive and hold a roll of material in a first dispensing position and a second dispensing position. The dispenser further includes a roll transfer apparatus. Upon the diameter of roll of material reaching a transfer diameter size, the roll transfer apparatus facilitates movement of the roll of material from the first dispensing position to the second dispensing position.

Certain embodiments provide a roll transfer apparatus including a transfer arm configured to hold the roll of material in a first dispensing position. The transfer arm includes a first end having a transfer arm roller configured to engage the roll of material and a second end engaged with a transfer disk. The transfer apparatus also includes a transfer latch having a first end configured to engage the transfer disk. When the diameter of the roll of material reaches a certain transfer diameter size, the second end of the transfer arm engages the first end of the transfer latch in such a manner that causes the transfer latch to disengage from the transfer disk to facilitate movement of the roll of material from the first dispensing position to the second dispensing position. The transfer disk includes a notch configured to securely engage the transfer latch when the jumbo roll is in the first dispensing position. The transfer disk also includes a spring engagement mechanism configured to be secured to an extension spring located on a recessed portion of the backside of the rear housing. The transfer disk also includes a transfer disk protrusion that is configured to engage a transfer disc control slot that is located in the backplate of the rear housing. When the hook disengages from the notch, the extension spring rotates the transfer disk to an extent permitted by the transfer disc control slot, which forces the transfer arm roller against the roll of material, thus, facilitating movement of the roll of material from the first dispensing position to the second dispensing position. The transfer disk and transfer latch can be securely attached to the first side of the backplate that generally forms and faces the housing interior.

In some embodiments, the dispenser includes one or more rollers and a ramp configured to facilitate moving the roll of material from the first position to the second position. The ramp may have an opening to allow for dispensing of the material from the jumbo roll. The ramp generally includes a first end located in closer proximity to the roll of material in the first dispensing position and a second end located closer in proximity to the roll of material in the second dispensing position. The first end of the ramp is elevated in comparison to the second end of the ramp to allow for gravitational forces to further facilitate movement of the roll of material from the first dispensing position to the second dispensing position.

In certain embodiments, the roll of material can be supported by a stub roll support base and an upper stub roll support member when the roll of material is in the second dispensing position.

The housing of the dispenser can also include an access opening configured to permit a user to access a sheet of material from the roll of material. The access opening may define a perimeter having one or more tear members situated along at least a portion of the perimeter. The tear members can facilitate tearing of the material from the jumbo roll, such that it can then be utilized by the end user. The roll of material can include a jumbo roll of toilet tissue.

In embodiments, the dispenser includes a locking mechanism for locking the openable cover to the rear housing. The openable cover can be attached to the rear housing via a hinge.

Also provided herein are methods for installing or replacing a roll of material from a dispenser.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
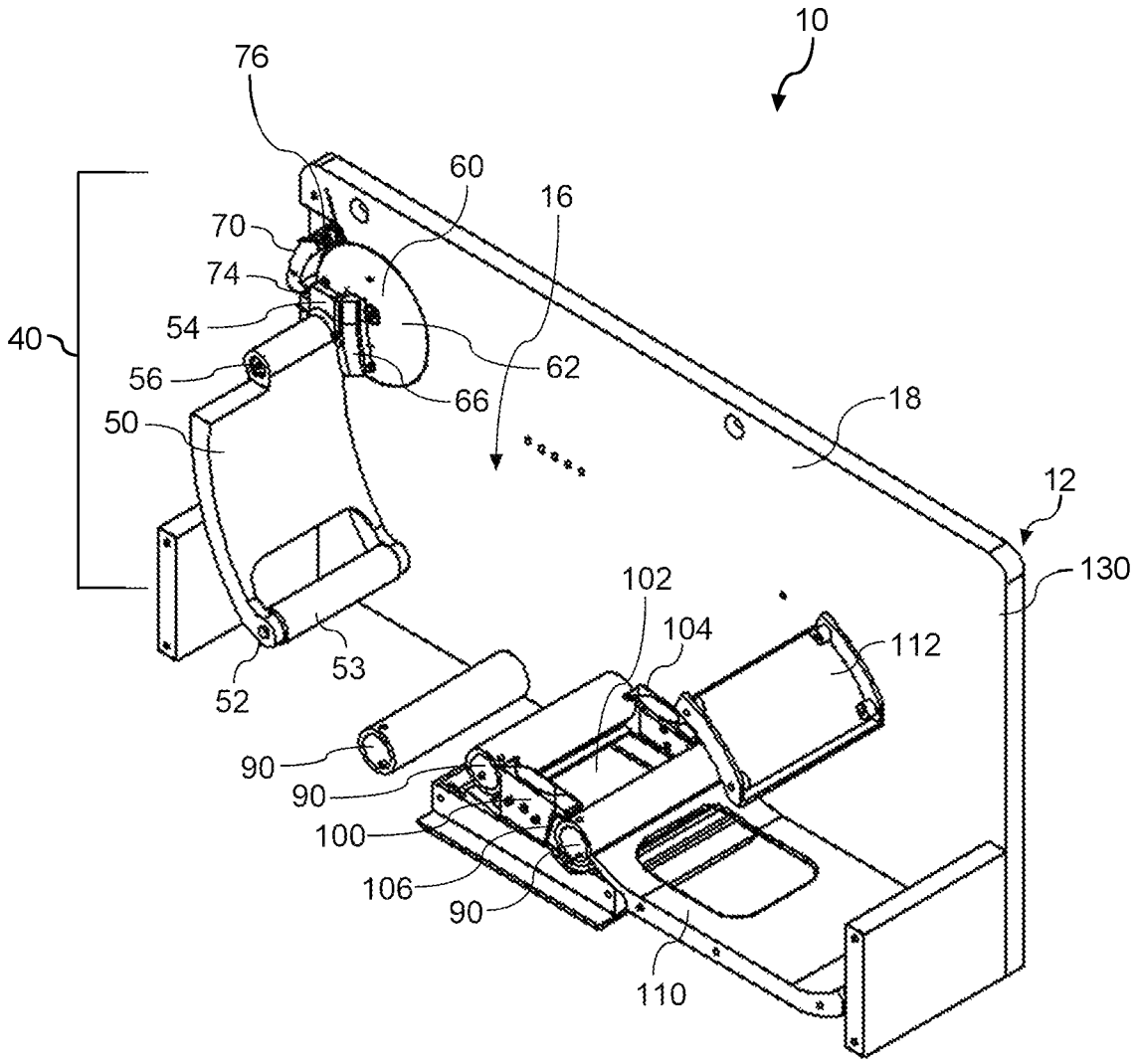
FIG. 1 is a perspective view of one embodiment of a dispenser in accordance with the present disclosure with its openable cover not shown.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to a dispenser for a dispenser for a roll of material. More particularly, the present dispenser is directed to a dispenser that includes a roll transfer apparatus for moving a roll of material from a first dispensing position to a second dispensing position. Moving the roll of material from the first dispensing position to the second dispensing position allows for restroom personnel to more easily install or replace jumbo rolls of material in the dispenser. When the roll of material is located in the second dispensing position, the first dispensing position is available for accepting a new roll of material. Accordingly, when the restroom personnel opens the cover of the dispenser, they can easily insert a new roll of material in the first dispensing position without having to first remove the partially used roll, also referred to as a stub roll. For other dispensers where the stub roll must first be removed, the washroom personnel must set the new roll of material down on a surface in the restroom. This is undesirable because it can introduce contaminants to the new roll of material. However, the disclosed dispenser eliminates the need to sit the new roll of material down while removing the stub roll from the dispenser. Furthermore, the dispenser disclosed herein allows for easier replacement of the partially used roll, which can save time for restroom personnel. In commercial restrooms having multiple jumbo roll dispensers, the time to service and replace partially used rolls can be greatly reduced allowing the restroom personnel to more efficiently service the commercial restroom.

Furthermore, the disclosed dispenser includes a first dispensing position and a second dispensing position, that can assist with eliminating waste in the form of unused product, such as toilet paper, that may be on the partially used roll. For example, many known jumbo roll dispensers only have one dispensing position for the roll of material. Accordingly, when using known dispensers, the washroom personnel must remove the partially used roll in order to refurnish the dispenser with a new roll of material. Material remaining unused on the stub roll generates product waste and economic loss. In certain situations where the partially used roll still contains a decent amount of material, the restroom personnel must decide whether to replace the partially used roll or not. In situations where the partially used roll is not removed, the roll may become fully depleted before the restroom personnel can make it back to replace the partially used roll with a new roll. Having fully depleted rolls is undesirable as there is no product available to the user. The present dispenser, however, eliminates this problem. For instance, the product transfer apparatus automatically transfers the partially used roll to a second dispensing position once the roll reaches a certain diameter. Product is still able to be dispensed from the second position and the restroom personnel is free to provide a new roll of material in the first dispensing position. Accordingly, material can be fully removed from the partially used roll in the second dispensing position and then product can be accessed from the roll in the first dispensing position.

In one embodiment, the dispenser includes a rear housing and an openable cover defining a housing interior. The housing interior is configured to receive a roll of material having a diameter. The rear housing includes a backplate that is configured to be mounted to a mounting surface. The housing interior is configured to receive and hold a roll of material in a first dispensing position and a second dispensing position. The dispenser also includes a roll transfer apparatus. The roll transfer apparatus is located in the interior housing. Upon the diameter of the roll of material reaching a transfer diameter size, the roll transfer apparatus facilitates movement of the roll of material from the first dispensing position to the second dispensing position. The roll transfer apparatus includes a transfer arm configured to hold the jumbo roll in a first dispensing position. The transfer arm includes a first end having a transfer arm roller configured to engage the roll of material and a second end engaged with a transfer disk. The roll transfer apparatus also includes a transfer latch having a first end including a hook configured to engage the transfer disk. Upon the roll of material reaching the transfer diameter size, the second end of the transfer arm engages the transfer latch such that the hook disengages from the transfer disk to facilitate movement of the roll of material from the first dispensing position to the second dispensing position.

Figure 2:
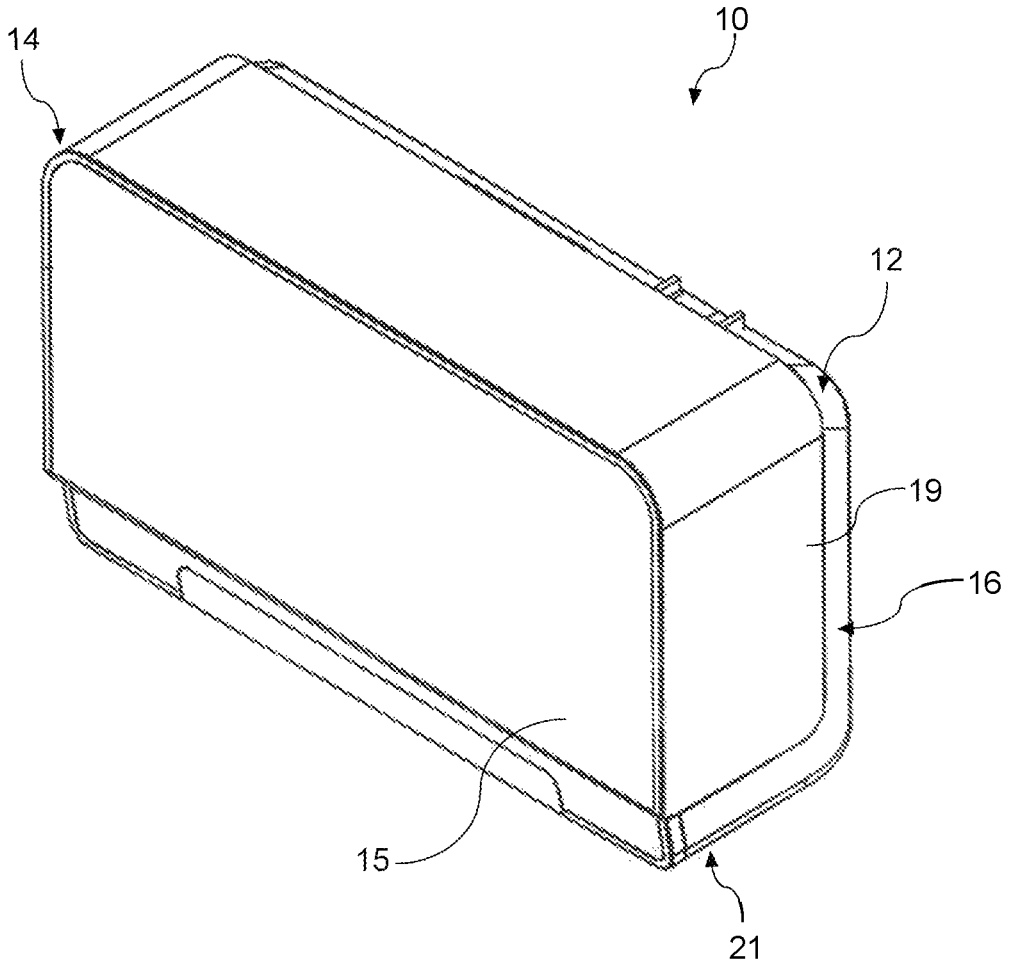
FIG. 2 is a perspective view of one embodiments of a dispenser having the openable cover in a closed position in accordance with the present disclosure.

Referring particularly to FIGS. 1-2 and 6-10 various embodiments of dispenser 10 made according to the present disclosure are illustrated. As shown in FIGS. 1-2 the dispenser 10 includes a rear housing 12 including a backplate 18. The dispenser 10 also includes an openable cover 14, the openable cover 14 encloses at least a portion of said backplate 18 to form a housing having a housing interior 16 so as to retain at least one roll of a roll of material 20. The dispenser 10 can be mounted to a mounting surface such as the wall of a restroom or the stall of a restroom. The dispenser 10 can be mounted to the mounting surface via any suitable mechanism.

The dispenser 10 can include a rear housing 12 and an openable cover 14 that can have any desired overall shape. The dispenser 10 can include a two-part configuration. For example, the dispenser 10 can include a rear housing 12 and an openable cover 14. The openable cover 14 can be pivotally mounted to the rear housing 12 using any suitable means. For example, in one embodiment, hinges can be used to connect the openable cover 14 to the rear housing 12. Alternatively, the openable cover 14 can be completely separable from the rear housing 12. The openable cover 14 generally defines the front face 15 and at least a portion of the sidewalls 19 of the dispenser 10, while the rear housing 12 defines the back of the dispenser 10. In certain embodiments, the sidewalls 19 may be defined entirely by the openable cover 14. In some embodiments, the rear housing 12 can also define at least a portion of the sidewalls 19 of the dispenser 10. In certain embodiments, the side walls may be entirely defined by the rear housing 12. In other embodiments, the sidewalls 19 may be entirely defined by the openable cover 14. In some embodiments, the openable cover 14 may have sidewalls that cooperate with the sidewalls of the rear housing 12. The openable cover 14 may be in a closed or open position. The openable cover 14 may form at least a portion of the top wall 13 of the dispenser 10. As shown in FIG. 2, the openable cover 14 is in a closed position, thus covering the interior of the dispenser 10. The rear housing 12 and openable cover 14 can define housing interior 16 for housing the operational components of the dispenser 10, as well as rolls of sheet material to be dispensed, including a roll of material 20. In certain embodiments, the rear housing 12 can also form at least a portion of the bottom 21 or bottom surface of the dispenser 10.

The openable cover 14 defines at least a portion of the housing interior 16. In certain embodiments, the openable cover 14 can include a locking mechanism configured to lock the openable cover 14 to the rear housing 12 such that product contained within the dispenser cannot be accessed without engaging the locking mechanism. (Not Shown). For example, the locking mechanism can be a lock configured to open with a key. Thus, the contents of the housing interior 16 cannot be accessed without having the key. Certain restroom personnel that service the restroom may have the key for accessing the dispenser 10.

Figure 3:
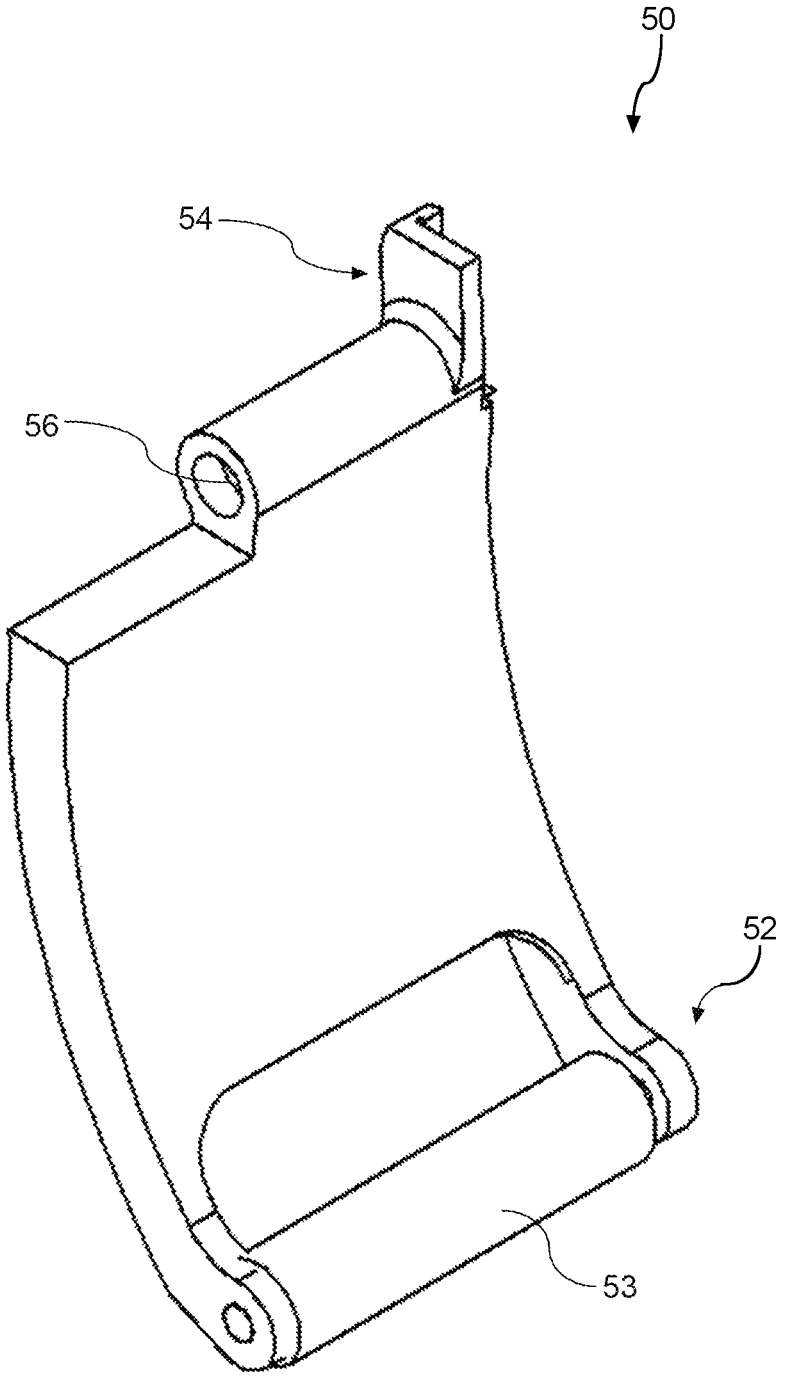
FIG. 3 is an exploded view of one embodiment of a transfer arm in accordance with the present disclosure.
Figure 4A:
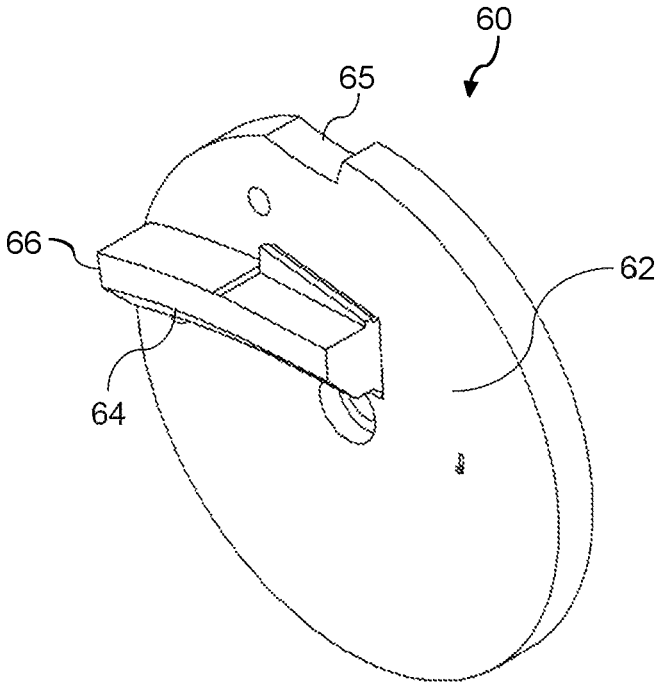
FIG. 4 is an exploded view of one embodiment of a transfer disk in accordance with the present disclosure.
Figure 4B:
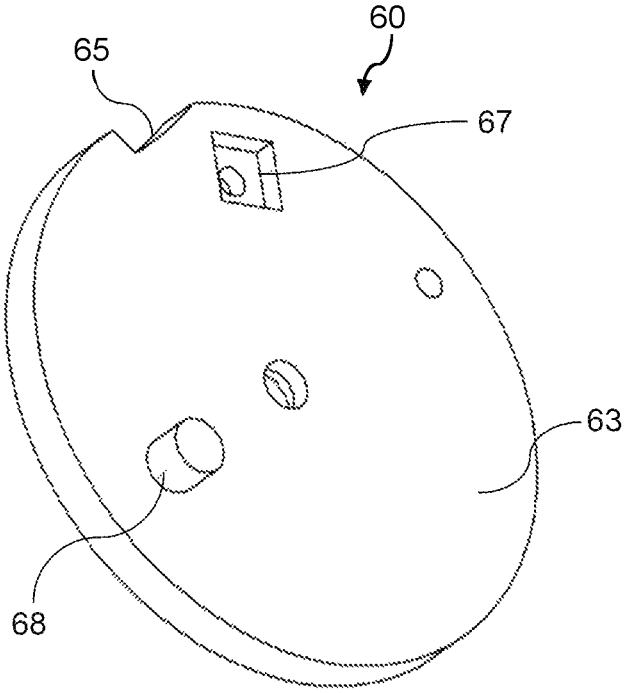
Figure 5:
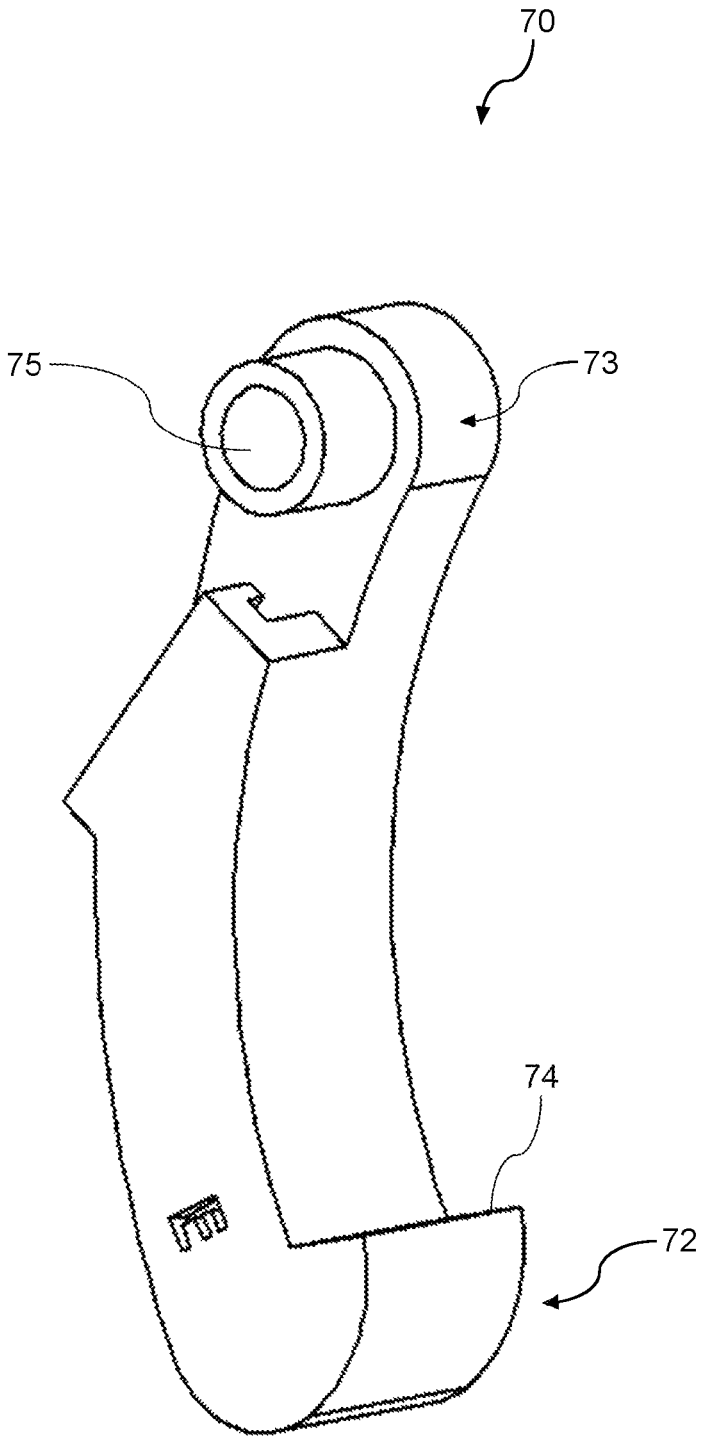
FIG. 5 is an exploded view of one embodiments of a transfer latch in accordance with the present disclosure.

The dispenser 10 also includes a roll transfer apparatus 40 that is located generally in the housing interior 16. The roll transfer apparatus 40 can include a transfer arm 50, a transfer disk 60, and a transfer latch 70. Elements of the roll transfer apparatus 40 can be affixed to a first side 130 of the backplate 18 in any suitable manner. Exploded view of the transfer arm 50, transfer disk 60, and transfer latch 70 are shown in FIGS. 3-5. The transfer arm 50 can include a first end 52 and a second end 54. The transfer arm 50 includes a transfer arm roller 53 generally located along the first end 52 of the transfer arm 50. The transfer arm roller 53 is configured such that it engages at least a portion of the surface of the roll of material 20 when the roll of material 20 is in a first dispensing position 22 in the dispenser 10. The transfer arm 50 also includes a second end 54 configured to securely engage with the transfer disk 60. The transfer arm 50 can be securely attached to the transfer disk via any suitable mechanism. The transfer arm 50 also includes a transfer arm pivot 56 and a transfer arm torsion spring 57 generally located about the second end 54 of the transfer arm 50. The transfer arm pivot 56 and transfer arm torsion spring 57 allow for movement of the transfer arm 50 about the transfer arm pivot 56 as the diameter of the roll of material 20 changes. The transfer arm torsion spring 57 holds the transfer arm roller 53 against the roll of material 20. As the product is dispensed, the transfer arm roller 53 is held in engagement with the roll of material 20 via the transfer arm torsion spring 57. In addition to tracking with the roll of material 20, the transfer arm roller 53 applies light pressure to the roll of material 20 as the material is dispensed, which helps to reduce overpsin of the product during roll dispensing.

The transfer disk 60 includes a first side 62 and a second side 63. The first side 62 generally faces the housing interior 16 and the second side 63 of the transfer disk 60 generally faces the backplate 18 of the rear housing 12. The first side 62 of the transfer disk 60 includes a transfer arm engagement member 66 having a jumbo roll engagement surface 64 thereon. The transfer arm engagement member 66 is configured to engage and secure at least a portion of the transfer arm 50 to the transfer disk 60. The transfer arm 50 may be secured to the transfer arm engagement member 66 via any suitable mechanism. The jumbo roll engagement surface 64 is also configured to engage at least a portion of the roll of material 20 when the roll of material 20 is in a first dispensing position 22. The transfer disk 60 also includes a notch 65. The notch 65 is configured to engage the transfer latch 70. In some embodiments, the notch 65 engages the transfer latch 70 when the roll of material 20 is in the first dispensing position 22. The second side 63 of the transfer disk 60 includes a spring engagement mechanism 67 and a transfer disk protrusion 68. The spring engagement mechanism 67 is configured to engage an extension spring 82 located about the second side 131 of the backplate. The transfer disk protrusion 68 is configured to engage with a transfer disk control slot 84 also located on the backplate 18 of the rear housing 12.

The transfer latch 70 includes a first end 72 and a second end 73. The first end 72 of the transfer latch 70 is configured to engage the transfer disk 60. The first end 72 includes a transfer disk engagement mechanism configured to releasably attach the first end 72 of the transfer latch 70 to the transfer disk 60. Any suitable transfer disk engagement mechanism can be utilized. For example, as shown, the first end 72 of the transfer latch 70 can include a hook 74. The hook 74 is configured such that it engages the notch 65 of the transfer disk 60 when the roll of material 20 is in the first dispensing position 22. In other embodiments, the transfer disk engagement mechanism can include a flange or protrusion configured to engage the notch 65 of the transfer disk 60. Still in other embodiments, the transfer disk engagement mechanism can include a groove configured to engage a surface or flange located on the transfer disk 60. The transfer disk engagement mechanism can include any releasable fastening mechanism such as members, protrusions, flanges, etc. configured to engage and releasably secure the transfer latch 70 to the transfer disk 60. The transfer latch 70 also includes a transfer latch pivot 75 and a transfer latch torsion spring 76 generally located about the second end 73 of the transfer latch 70. The transfer latch pivot 75 and transfer latch torsion spring 76 allow for movement of the transfer latch 70 about the pivot 75 as the diameter of the roll of material 20 changes. The transfer latch 70 is held in engagement with the transfer disk 60 via the transfer disk notch 65 via the transfer latch torsion spring 76.

Figure 6:
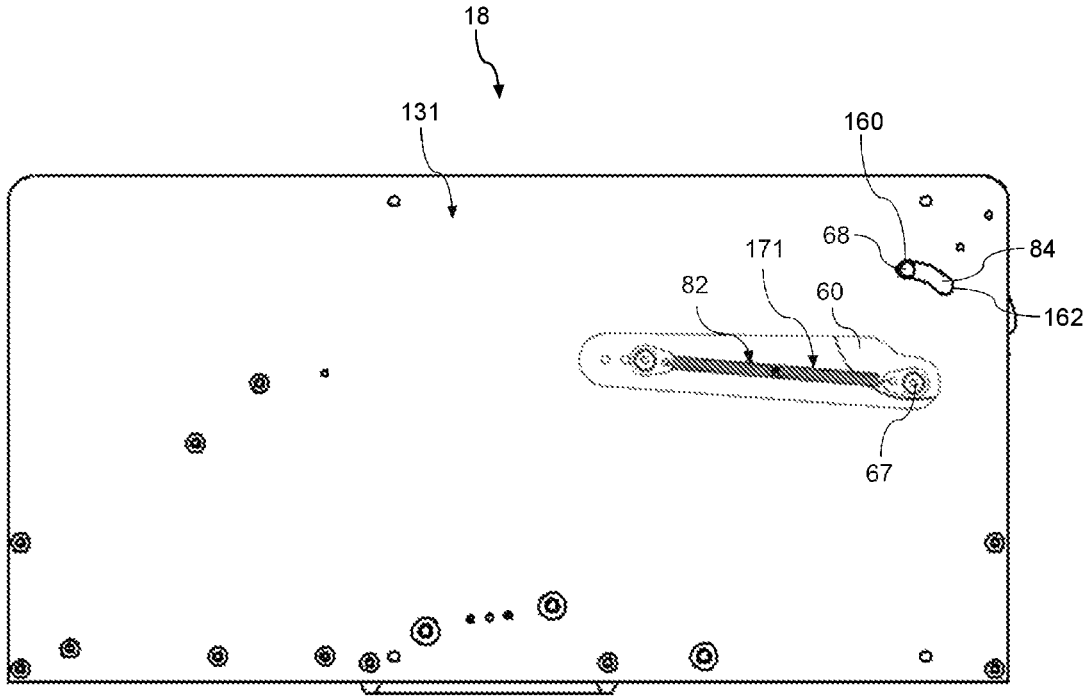
FIG. 6 is a plan view of one embodiment of the rear side of a dispenser in accordance with the present disclosure.
Figure 7:
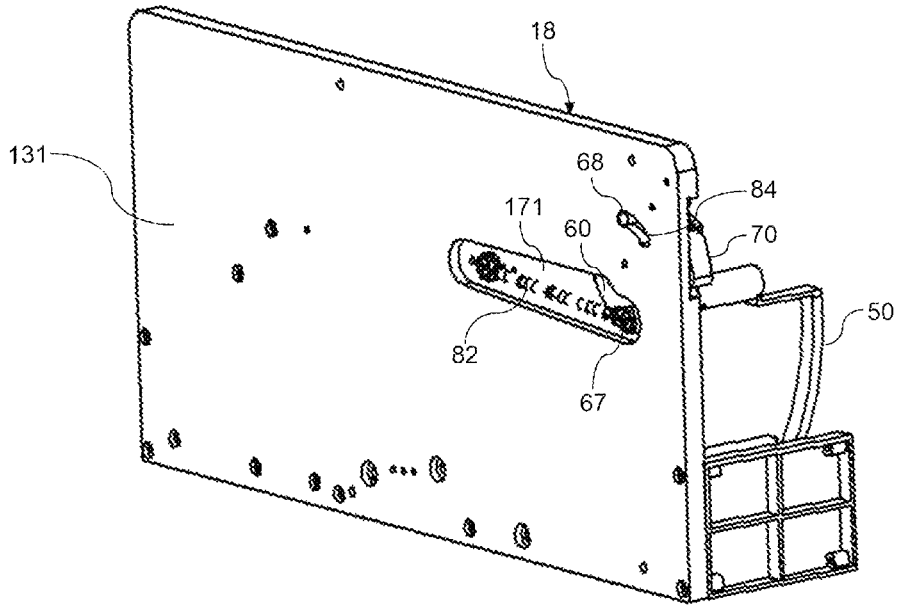
FIG. 7 is a perspective view of one embodiment of the rear side of a dispenser in accordance with the present disclosure.

As shown in FIG. 6, the rear housing 18 has a second side 131, which corresponds to the side that is generally facing the mounting surface when in a mounted position. Also, as shown in FIGS. 6-7, the backplate 18 can generally have a recess 171 for housing the extension spring 82. As shown, at least a portion of the recess 171 can include a hole such that one end of the extension spring 82 can engage with the transfer disk spring engagement mechanism 67 of the transfer disk 60. In certain embodiments, the transfer disk spring engagement mechanism 67 can include an opening capable of receiving and holding a hooked or curved portion of the extension spring 82, as shown in FIGS. 6-7. Accordingly, the transfer disk spring engagement mechanism 67 can be any suitable mechanism capable of retaining at least one end of the extension spring 82 when the extension spring 82 is in an extended position and also when the extension spring is in a less extended position or a non-extended position.

As shown in FIGS. 6-7, the backplate 18 can include a transfer disk control slot 84. The transfer disk control slot 84 is generally shaped such that it can receive and engage the transfer disk protrusion 68. As shown, the transfer disk control slot 84 has a first end 160 and a second end 162. The first end 160 engages the transfer disk protrusion 68 when the roll of material 20 is in the first dispensing position 22. For example, when the hook 74 of the transfer latch 70 is securely engaged with the notch 65 of the transfer disk 60, the transfer disk protrusion 68 is generally secured in the first end 160 of the control slot. As the second end 54 of the transfer arm 50, pushes the hook 74 of the transfer latch 70 out of engagement with the notch 65 of the transfer disk, the energy of stored in the extension spring 82 will rotate the transfer disk 60. However, the transfer disk 60 rotation is stopped once the transfer disk protrusion 68 reaches the second end 162 of the transfer disk control slot 84.

Figure 8:
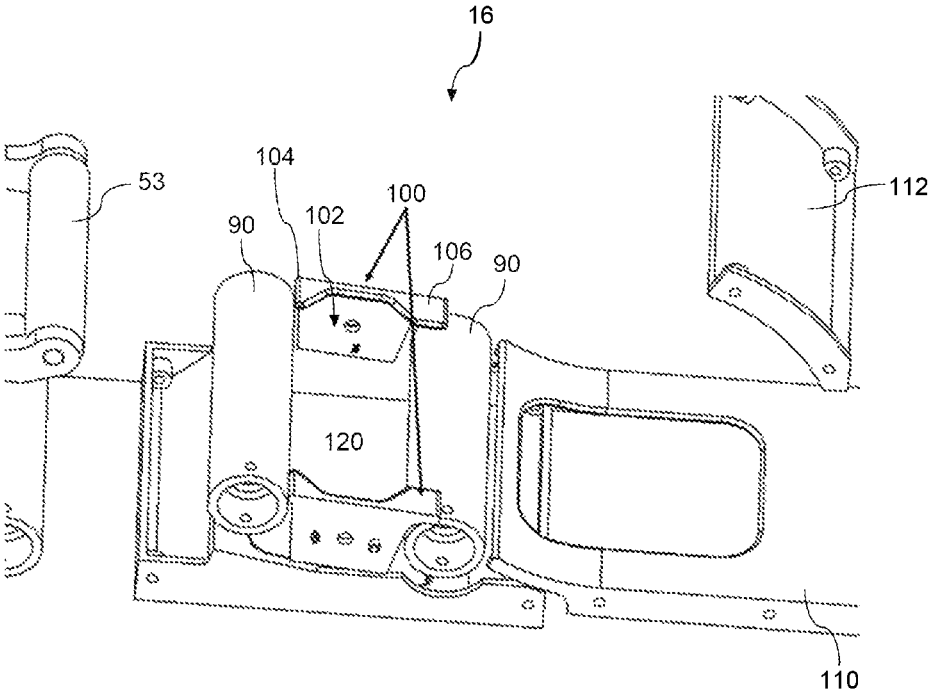
FIG. 8 is a perspective view of one embodiment of the interior bottom of a dispenser in accordance with the present disclosure.

Referring to FIG. 8, the dispenser 10 also includes one or more rollers 90 situated along the bottom of the housing interior 16 for facilitating movement of the roll of material 20 from the first dispensing position 22 to a second dispensing position 24. As shown in FIG. 8, the dispenser 10 also includes a ramp 100 having a ramp opening 102. Material from the roll of material 20 may be dispensed through the ramp opening 102. The ramp 100 can be located between one or more rollers 90. The ramp opening 102 can also be positioned above the housing access opening 120 such that the product can be dispensed from the housing access opening 120. The ramp 100 has a first end 104 and a second end 106. The first end 104 is closer in proximity to the roll of material 20 when it is in the first dispensing position 22. The second end 106 of the ramp 100 is in closer proximity to the roll of material 20 when it is in the second dispensing position 24. The first end 104 is elevated in comparison to the second end 106 in order to facilitate movement of the roll of material 20 from the first dispensing position 22 to the second dispensing position 24. Once the partially depleted roll is on top of the ramp 100, the slope of the ramp 100 will facilitate allowing the partially depleted roll of material 20 to move into the second dispensing position 24.

Figure 9:
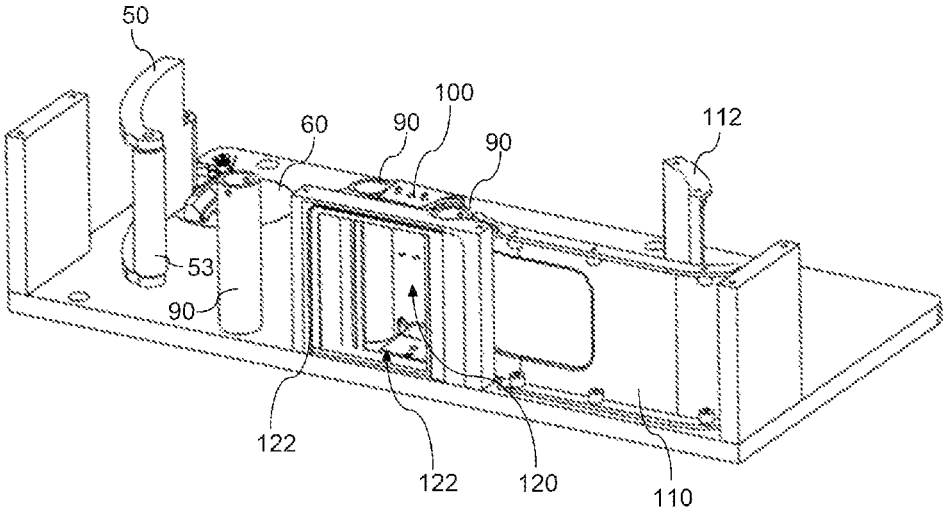
FIG. 9 is a perspective view of one embodiment of the bottom of the dispenser in accordance with the present disclosure.

Referring now to FIG. 9, the dispenser 10 includes a housing access opening 120 having a housing access opening perimeter 121. The housing access opening 120 can have one or more tear members 122 situated about the housing access opening perimeter 121 to facilitate tearing and removal of the material product form the jumbo roll. In some embodiments, the one or more tear members 122 may include serrated molded plastic teeth suitable for separating material product from the roll of material 20.

Figure 10:
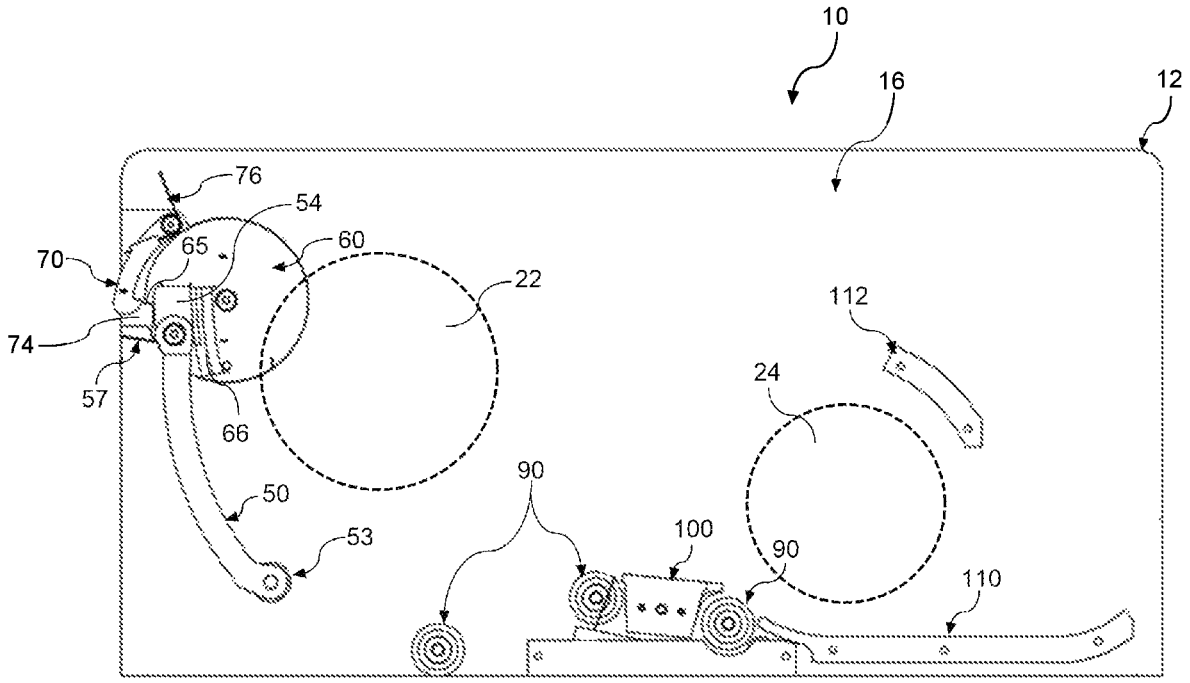
FIG. 10 is a planar view of one embodiment of an empty dispenser in accordance with the present disclosure.
Figure 11:
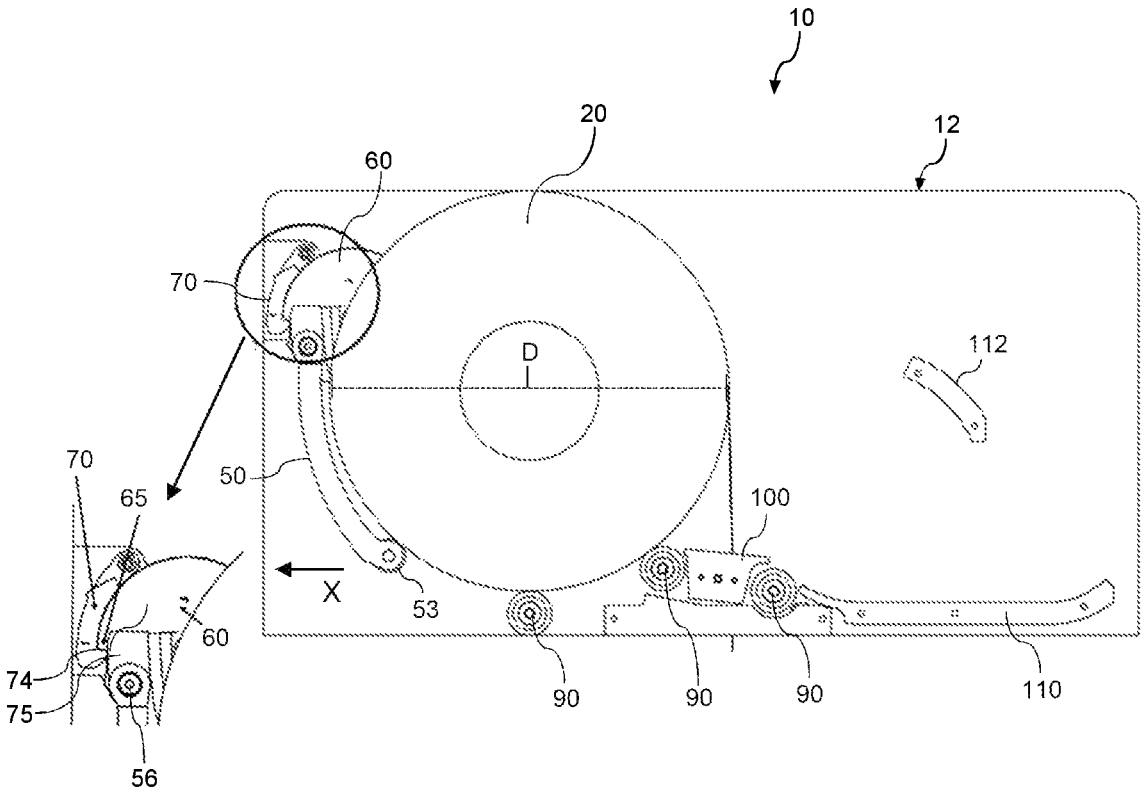
FIG. 11 is a planar view of one embodiment of a dispenser having a roll of material in a first dispensing position loaded therein in accordance with the present disclosure.

As shown in FIG. 10, the dispenser 10 includes a housing interior 16 capable of holding the roll of material 20 in a first dispensing position 22 and a second dispensing position 24. The dispenser of FIG. 10 is empty and does not have a roll of material 20 inserted therein. FIGS. 10-17 illustrate the movement of a roll of material 20 from the first dispensing position 22 to the second dispensing position 24. Referring to FIG. 11, when restroom personnel load a new roll of material into the dispenser 10 they must move the transfer arm 50 fully in the direction of Arrow X, which stretches the extension spring 82 and allows the transfer latch 70 to engage the notch 65 of the transfer disk 60, thus locking the transfer disk 60 in place and storing energy in the extension spring 82. As shown, a portion of the roll of material 20 may rest on one or more rollers 90 in order to assist removal of product from the roll of material 20. The roll of material 20 generally has a diameter "D" that decreases as product is removed from the roll. As shown, when the roll of material 20 is in the first dispensing position 22, the transfer arm roller 53 is also in contact with the roll of material 20 when it is in the first dispensing position.

Figure 12:
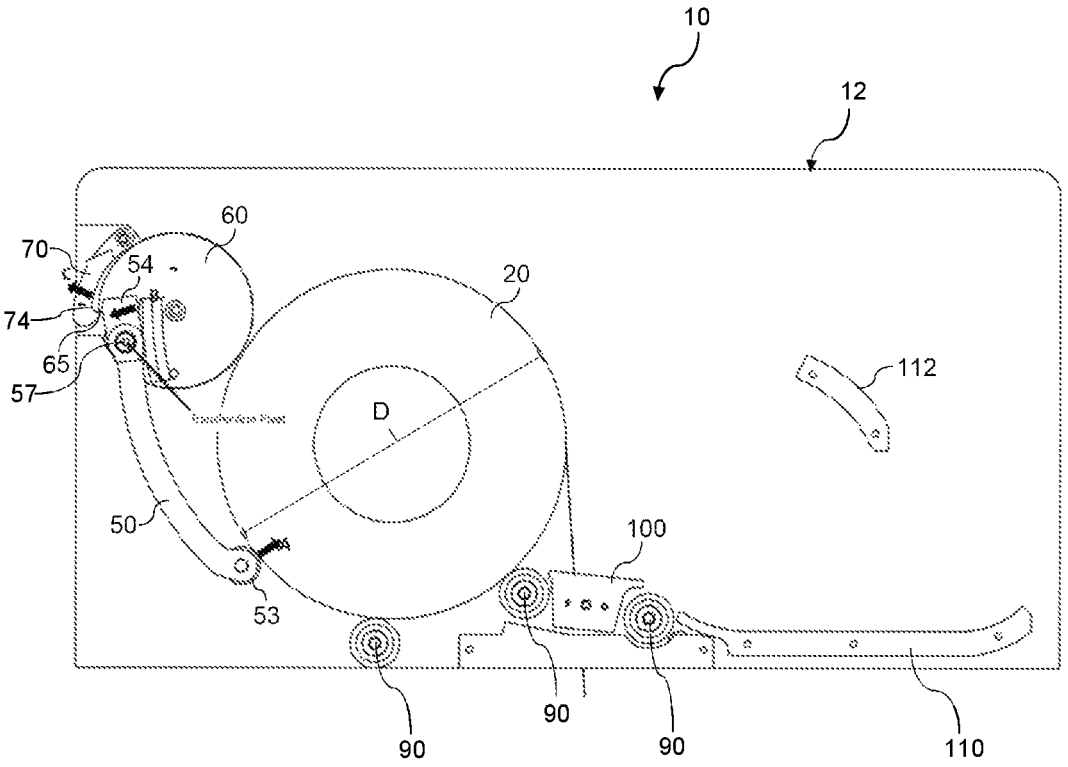
FIG. 12 is a planar view of one embodiment of a dispenser having a roll of material in a first dispensing position loaded therein in accordance with the present disclosure.
Figure 13:
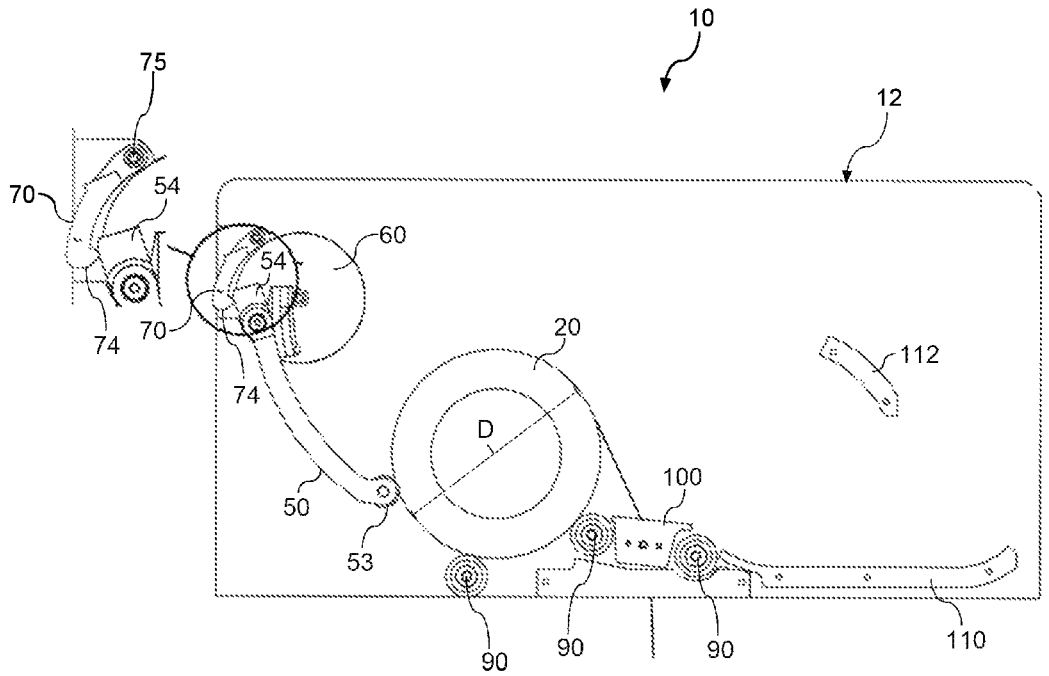
FIG. 13 is a planar view of one embodiment of a dispenser having a roll of material moving out of a first dispensing position in accordance with the present disclosure.

Referring now to FIG. 12, as the transfer arm 50 and the transfer arm roller 53 track with decreasing product roll the transfer arm 50 moves in the direction of Arrow A. The movement of the transfer arm 50 in the direction of Arrow A causes the second end 54 of the transfer arm 50 extending above the transfer arm pivot 56 to move in the direction of Arrow B, which causes the transfer latch 70 to gradually move out of engagement with the transfer disk 60. When the roll of material 20 reaches a transfer diameter size, the second end 54 of the transfer arm 50 will have moved the transfer latch 70 completely out of engagement with the transfer disk 60. See FIG. 13. Once the transfer latch 70 is disengaged from the transfer disk 60, the extension spring 82 can return its stored energy to the transfer apparatus system thus rotating the transfer disk 60 to the extent permitted by the transfer disk protrusion 68 and the transfer disk control slot 84. The release of the extension spring 82 forces the transfer arm 50 against the partially depleted roll of material 20, thus driving the roll of material 20 up, onto and over the ramp 100, as shown in FIGS. 13-14.

Figure 14:
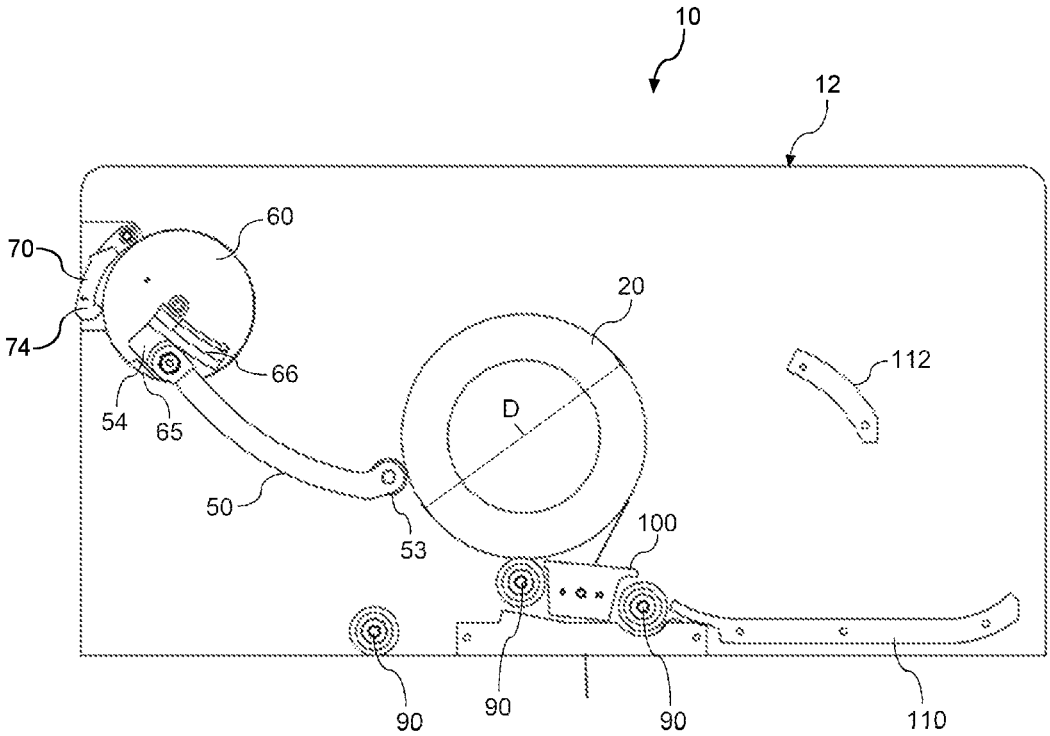
FIG. 14 is a planar view of one embodiment of a dispenser having a roll of material moving out of a first dispensing position in accordance with the present disclosure.
Figure 15:
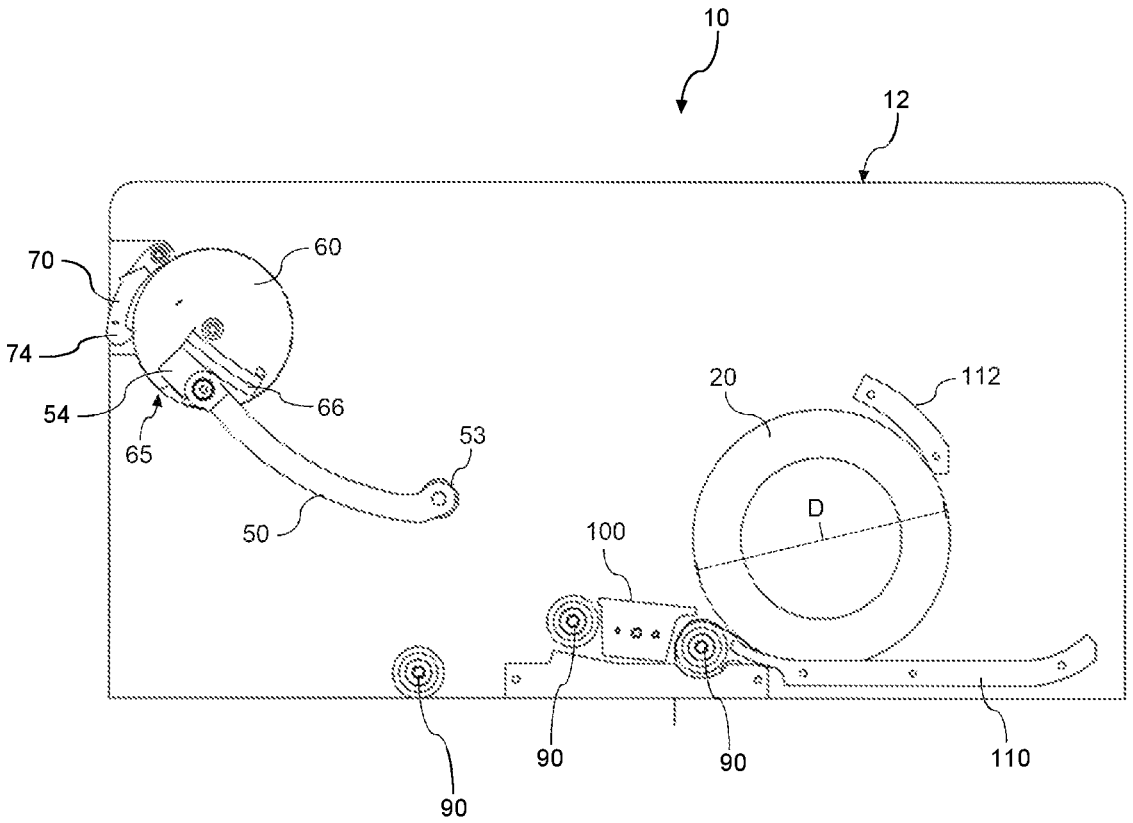
FIG. 15 is a planar view of one embodiment of a dispenser having a roll of material in a second dispensing position in accordance with the present disclosure.

Once the roll of material 20 is placed on the ramp 100, the ramp will facilitate movement of the roll of material 20 to the second dispensing position 24 as shown in FIGS. 14-15. The dispenser 10 also includes a stub roll support base 110 and an upper stub roll support member 112 configured to engage and secure the roll of material 20 in the second dispensing position 24. In certain embodiments, the edges of the ramp 100 function to prevent the roll of material 20 in a second dispensing position 24 from being pulled off the stub roll supports, including the stub roll support base 110 and the upper stub roll support member 112.

As shown in FIGS. 11-16, the roll of material 20 generally has a diameter as shown by "D". For certain rolls of material known as large rolls or jumbo rolls, the initial diameter "D" of a full, unused from may be from about 15 cm to about 35 cm, such as from about 17 cm to about 32 cm. Once the diameter "D" of the roll of material 20 reaches a transfer diameter size, the roll transfer apparatus facilitates movement of the roll of material 20 from the first dispensing position 22 to the second dispensing position 24. In certain embodiments, the transfer diameter may range from about 5 cm to about 25 cm, such as from about 10 cm to about 17 cm.

Figure 16:
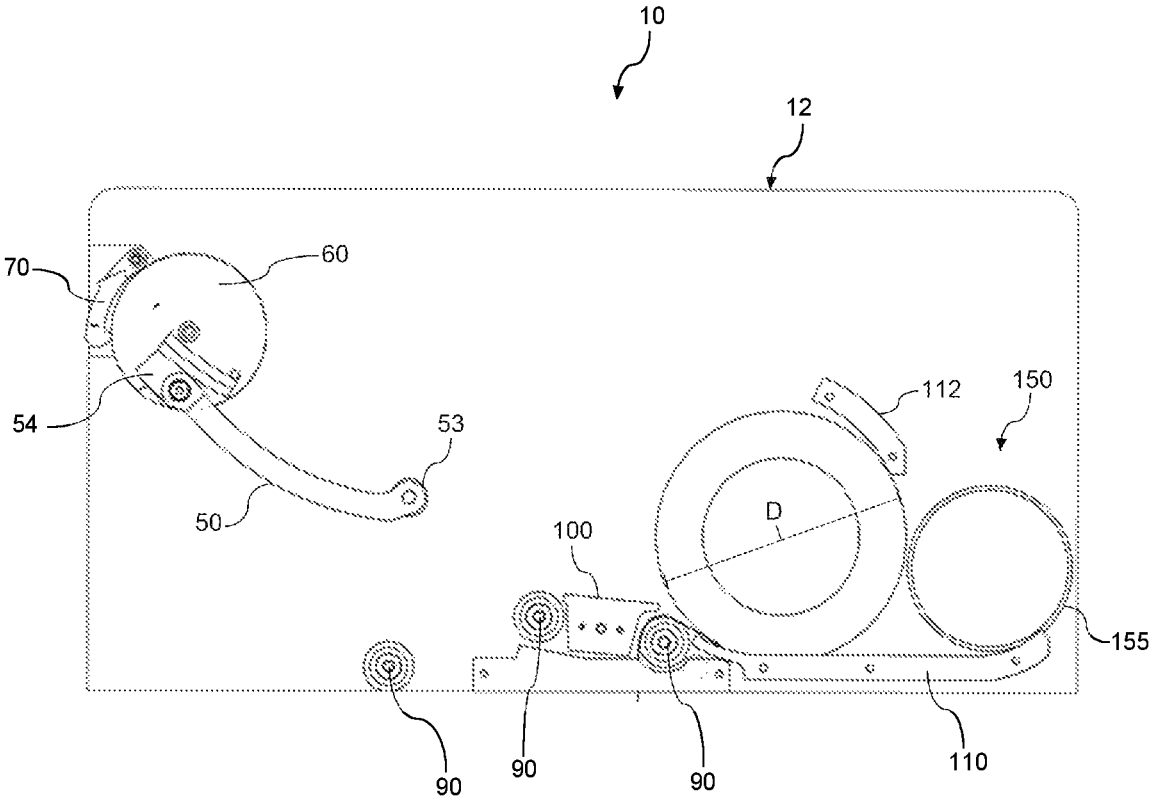
FIG. 16 is a planar view of one embodiment of a dispenser having a roll of material in a second dispensing position and an empty core in the rear housing in accordance with the present disclosure.
Figure 17:
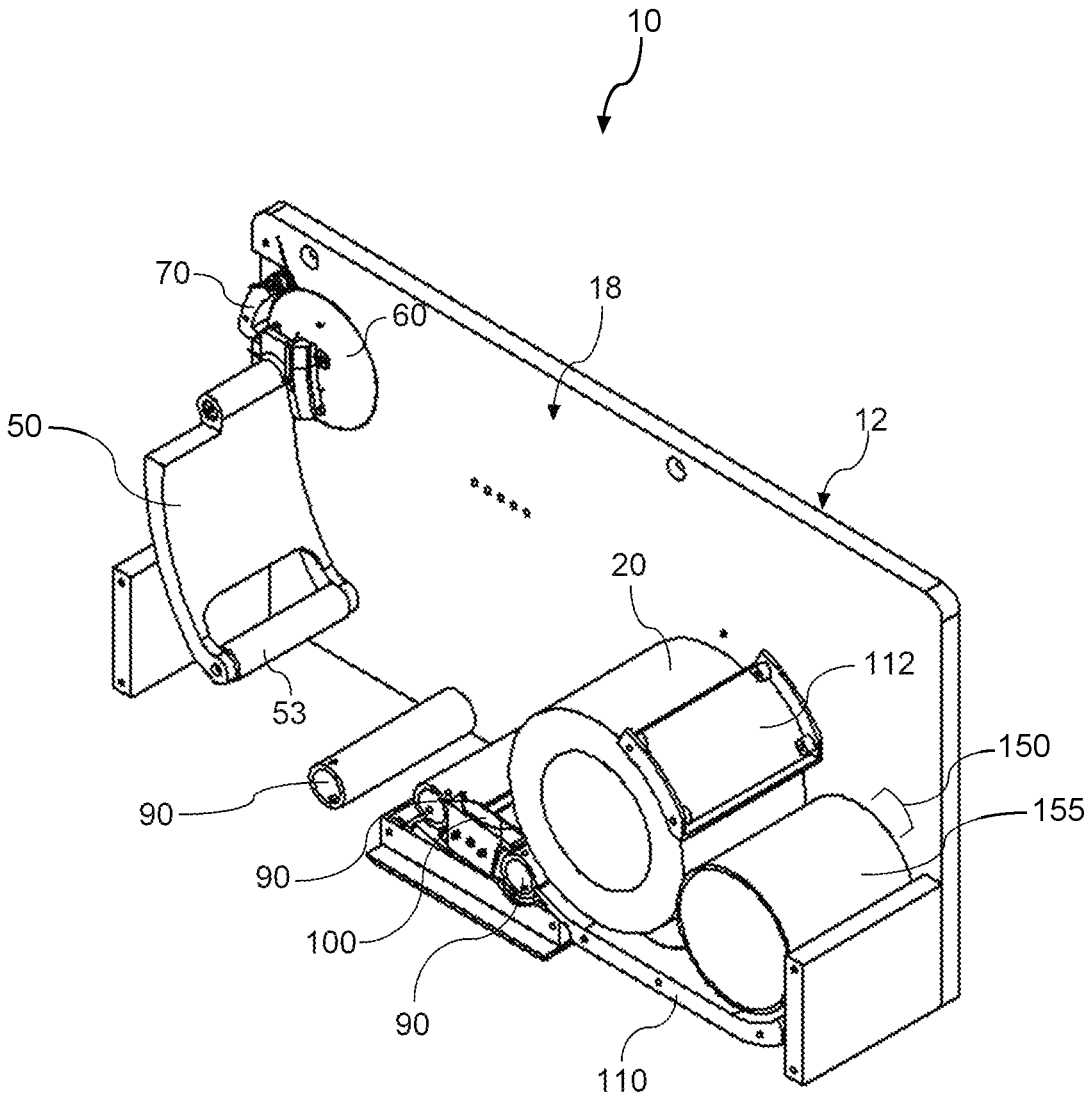
FIG. 17 is a perspective view of one embodiment of a dispenser having a roll of material in a second dispensing position and an empty core in the rear housing in accordance with the present disclosure.

Referring now to FIGS. 16-17, the dispenser 10 may also include a rearward section 150 that defines an opening or a space sufficient to allow an empty core 155 from the roll of material 20 to pass by and be stored in the rearward section 150 until such time as the service personnel arrives to service the dispenser 10. For example, the roll of material 20, can include a sheet of material or sheets of material that are wound around a core, such as paperboard core. The dispenser 10, is capable of automatically moving the roll of material 20 from the first dispensing position 22 to the second dispensing position 24. It is contemplated, that restroom personnel can insert a fresh or new roll of material 20 in a first dispensing position 22 without removing the remaining roll of material located in the second dispensing position 24. Once the roll of material is the second dispensing position 24 is depleted it can remain in the second dispensing position while material is then removable from the fresh roll of material 20 in the first dispensing position 22. However, once the roll of material in the first dispensing position 22 reaches the particular transfer diameter, the roll transfer apparatus 40 will move the material roll into the second dispensing position 24 and the fully used core currently occupying the second dispensing position will be pushed into the rearward section 150 so that the roll of material can be utilized in the second dispensing position 24. In said embodiments, the remaining core of a completely used roll of material will not impede another roll of material from moving from the first dispensing position 22 to the second dispensing position 24.

One or more fasteners can be used to secure the rear housing 12 to the mounting surface, such as the interior wall of a restroom stall. Indeed, the backplate 18 of the rear housing 12 can include one or more openings configured to receive a fastener for securing the rear housing 12 to the mounting surface. The fastener can include any hardware device that mechanically joins affixes two or more objects together. The fastener(s) can be used to join the rear housing 12 to the mounting surface to a bracket located on the mounting surface. The fastener(s) can include those that are able to create non-permanent joints, that is, the joint can be removed or dismantled without damaging the joined components. Thus, the fastener(s) selected can be used to removably join the rear housing 12 to the mounting surface. Any suitable fastener can be used. Suitable fasteners include, but are not limited to, anchors, bolts, nails, nuts, pins, clips rivets, rods, screws, clamps, washers, and combinations thereof. In one embodiment, the fastener(s) includes a screw.

The present dispenser 10 can be used to hold any material stored on or dispensed from a roll, including but not limited to toilet paper, paper towels, hand towels, plastic materials etc. In certain embodiments, the roll of material includes a jumbo roll of toilet paper or toilet tissue. While in many embodiments, the roll of material will include a core, it is contemplated that the present disclosure can also be used with coreless products or small core products.

Also provided are methods for replacing a roll of material or for inserting a roll of material into a dispenser including accessing the housing interior, placing a roll of material in the first dispensing position, removing a partially used roll of material (i.e. stub roll) or the core from a fully used roll of material from the second position, and securing the openable cover to the rear housing. The method further includes placing the roll of material on the transfer arm roller and moving transfer arm such that the hook of the transfer latch engages the notch of the transfer disk.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser for dispensing a roll of material, the dispenser comprising:

a housing comprising a rear housing and an openable cover defining a housing interior configured to receive a roll of material having a diameter, the rear housing having a backplate configured to be mounted to a mounting surface, wherein the housing interior is configured to receive and hold a roll of material in a first dispensing position and a second dispensing position;

a roll transfer apparatus comprising a transfer arm configured to hold the roll of material in a first dispensing position, wherein the transfer arm includes a first end having a transfer arm roller configured to engage the roll of material and a second end engaged with a transfer disk, and a transfer latch having a first end configured to releasably engage the transfer disk;

wherein upon the diameter of the roll of material reaching a transfer diameter size the second end of the transfer arm engages the transfer latch such that the first end of the transfer latch disengages from the transfer disk to facilitate movement of the roll of material from the first dispensing position to the second dispensing position, wherein the first end of the transfer latch comprises a transfer disk engagement mechanism.

2. The dispenser of claim 1, wherein the second end of the transfer arm comprises a transfer arm pivot having a transfer arm torsion spring configured therewith to allow for movement of the transfer arm about the pivot as the diameter of the roll of material changes.

3. The dispenser of claim 1, wherein a first side of the transfer disk comprises a support having a transfer arm engagement surface configured to engage a surface of the transfer arm and a jumbo roll engagement surface configured to engage a jumbo roll when the jumbo roll is in the first dispensing position.

4. The dispenser of claim 1, wherein the transfer disk engagement mechanism comprises a hook.

5. The dispenser of claim 4, wherein the transfer disk comprises a notch, wherein the notch is configured to securely engage the hook when the jumbo roll is in the first dispensing position.

6. The dispenser of claim 5, wherein the transfer disk comprises a second side facing the backplate, wherein the second side of the transfer disk comprises a spring engagement mechanism configured to be secured to an extension spring located on a recessed portion of a backside of the backplate, further wherein the second side of the transfer disk comprises a transfer disk protrusion configured to engage a transfer disk control slot located in the backplate.

7. The dispenser of claim 6, wherein upon the hook disengaging from the notch, the extension spring is configured to rotate the transfer disk to an extent permitted by the transfer disk control slot to force the transfer arm roller against the roll of material to facilitate movement of the roll of material from the first dispensing position to the second dispensing position.

8. The dispenser of claim 1, wherein the dispenser further comprises one or more rollers configured to facilitate moving the roll of material from the first position to the second position.

9. The dispenser of claim 8, wherein the dispenser further comprises a ramp located between the one or more rollers, the ramp having an opening configured to allow for dispensing of material from a jumbo roll.

10. The dispenser of claim 9, wherein the ramp has a first end located closer in proximity to the roll of material in the first dispensing position and a second end located closer in proximity to the roll of material in the second dispensing position, wherein the first end is elevated in comparison to the second end to facilitate movement of the roll of material from the first dispensing position to the second dispensing position.

11. The dispenser of claim 1, further comprising a stub roll support base and an upper stub roll support member configured to hold a jumbo roll in the second dispensing position.

12. The dispenser of claim 1, wherein the transfer diameter size is from about 10 cm to about 17 cm.

13. The dispenser of claim 1, wherein the housing comprises an access opening configured to permit a user to access a sheet of material from the roll of material.

14. The dispenser of claim 13, wherein the access opening has a perimeter, wherein one or more tear members extend along at least a portion of the perimeter.

15. The dispenser of claim 1, wherein the roll of material comprises a jumbo roll of toilet paper.

16. The dispenser of claim 1, wherein backplate comprises a first side facing the housing interior and a second side facing the mounting surface, wherein the transfer latch and transfer disk are configured to be securely attached to the first side of the backplate.

17. The dispenser of claim 1, wherein the dispenser comprises a locking mechanism for locking the openable cover to the rear housing.

18. The dispenser of claim 1, wherein the openable cover is hingedly attached to the rear housing.

19. The dispenser of claim 1, further comprising a rearward section configured to hold an empty core from the roll of material.

* * * * *